US007425934B2

(12) United States Patent
Masumura et al.

(10) Patent No.: US 7,425,934 B2
(45) Date of Patent: Sep. 16, 2008

(54) DISPLAY PANEL DRIVE APPARATUS FOR DRIVING A DISPLAY PANEL

(75) Inventors: Yuuki Masumura, Fukuroi (JP); Yukihiro Matsumoto, Fukuroi (JP)

(73) Assignee: Pioneer Corporation, Tokyo (JP)

( * ) Notice: Subject to any disclaimer, the term of this patent is extended or adjusted under 35 U.S.C. 154(b) by 763 days.

(21) Appl. No.: 10/822,823

(22) Filed: Apr. 13, 2004

(65) Prior Publication Data

US 2004/0201546 A1 Oct. 14, 2004

(30) Foreign Application Priority Data

Apr. 14, 2003 (JP) ..... P2003-108625

(51) Int. Cl.
*G09G 3/28* (2006.01)

(52) U.S. Cl. ..... 345/60; 714/2; 345/3.1; 345/37

(58) Field of Classification Search ..... 345/60, 345/37, 3.1; 714/2, 24
See application file for complete search history.

(56) References Cited

U.S. PATENT DOCUMENTS 5,563,624 A * 10/1996 Imamura ..... 345/100
7,088,354 B2 * 8/2006 Matsumoto ..... 345/207
7,221,361 B2 * 5/2007 Konishi ..... 345/204
2002/0103007 A1 * 8/2002 Jaggers et al. ..... 455/557
2002/0186186 A1 * 12/2002 Hashimoto et al. ..... 345/63
2002/0186214 A1 * 12/2002 Siwinski ..... 345/212
2003/0052873 A1 * 3/2003 Ueda ..... 345/211
2003/0117382 A1 * 6/2003 Pawlowski et al. ..... 345/204
2003/0226044 A1 * 12/2003 Cupps et al. ..... 713/300
2003/0231550 A1 * 12/2003 Macfarlane ..... 367/198
2004/0100425 A1 * 5/2004 Kang et al. ..... 345/68
2004/0130556 A1 * 7/2004 Nokiyama ..... 345/617

* cited by examiner

*Primary Examiner*—Sumati Lefkowitz
*Assistant Examiner*—Grant D Sitta
(74) *Attorney, Agent, or Firm*—Sughrue Mion, PLLC

(57) ABSTRACT

A display-panel-drive apparatus having a drive unit that drives the display panel and a control unit that outputs control signals for controlling said drive unit to said drive unit, the display-panel-drive apparatus is provided with: a drive board of the drive unit; a control board of the control unit; a transmission line that transmits the control signals from the control board to the drive board by way of a removable connector; a detection device that detects when said connector is disconnected; and a control device that controls said drive unit when the detection device detects that the connector is disconnected; and wherein the detection device detects that said connector is disconnected by detecting when the connection terminals of the connector are disconnected.

2 Claims, 5 Drawing Sheets

DISPLAY PANEL DRIVE APPARATUS FOR DRIVING A DISPLAY PANEL

BACKGROUND OF THE INVENTION

1. Field of the Invention

This invention relates to a display-panel-drive apparatus that drives a display panel.

2. Related Art

A display-panel-drive apparatus comprising a drive unit that drives the display panel, and a control unit that outputs a control signal to the drive unit is known. With this kind of display-panel-drive apparatus, a specified drive pulse is supplied to the display panel by performing ON/OFF control of the switching element located in the drive unit based on a control signal from the control unit.

However, due to the mounting conditions, the drive unit and control unit may be constructed using separate boards, and in that case it is necessary to send control signals between the boards via a removable connector. Also, when sending control signals via the connector, it is not possible to give a proper control signal to the drive unit when the connector is disconnected, so there is a possibility of an abnormal display state or damage to the drive unit.

SUMMARY OF THE INVENTION

Taking the above inconveniences into consideration, it is the object of this invention to provide a display-panel-drive apparatus that is able to properly cope with disconnection of the connector.

The above object of the present invention can be achieved by a display-panel-drive apparatus of the present invention. The display-panel-drive apparatus having a drive unit that drives the display panel and a control unit that outputs control signals for controlling the drive unit to the drive unit, the display-panel-drive apparatus is provided with: a drive board of the drive unit; a control board of the control unit; a transmission line that transmits the control signals from the control board to the drive board by way of a removable connector; a detection device that detects when the connector is disconnected; and a control device that controls the drive unit when the detection device detects that the connector is disconnected; and wherein the detection device detects that the connector is disconnected by detecting when the connection terminals of the connector are disconnected.

According to the present invention, when it becomes impossible to properly transmit control signals by way of the transmission lines because the connectors are disconnected, it is possible for the protection device to adequately control the drive unit. Therefore, it is possible to prevent abnormal displays due to abnormal control signals, and to prevent damage to the drive unit.

In one aspect of the present invention can be achieved by the display-panel-drive apparatus of the present invention. The display-panel-drive apparatus of the present invention, wherein the control device stops operation of the drive device when the detection device detects that the connector is disconnected.

According to the present invention, when a detection signal that is output from a protection device becomes positive potential, or in other words, when it is detected that connectors are disconnected, the overall power supply of the plasma-display-panel-drive apparatus is turned OFF. Also, by a detection signal transitioning to positive potential, transmission of control signals is stopped, and switches of a scan driver are forcibly set to specified states. Therefore, it is possible to prevent damage to a drive unit.

In another aspect of the present invention can be achieved by the display-panel-drive apparatus of the present invention. The display-panel-drive apparatus of the present invention is, wherein the display-panel-drive apparatus drives a plasma display panel as the display panel.

According to the present invention, it is possible that the overall power supply of the plasma display panel drive apparatus is turned off and the operation of a scan driver is stopped when an error is detected.

In further aspect of the present invention can be achieved by the display-panel-drive apparatus of the present invention. The display-panel-drive apparatus is, wherein the control signals are signals that cause the drive unit to output scan pulses given to successive display lines for setting some of the discharge cells located on the plasma-display panel as light-emitting cells and some as non-emitting cells.

According to the present invention, it is possible that the overall power supply of the plasma display panel drive apparatus is turned off and the operation of a scan driver is stopped when an error is detected.

DESCRIPTION OF THE PREFERRED EMBODIMENT

An embodiment of applying the display-panel-drive apparatus of this invention to a plasma-display-panel-drive apparatus is explained below with reference to FIG. 1 to FIG. 7.

Figure 1A:
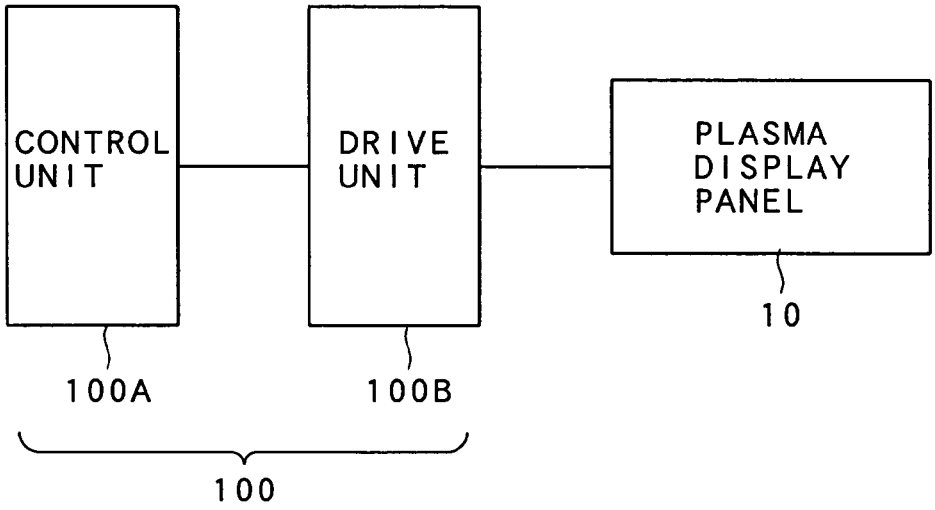
FIG. 1A is a block diagram showing the construction of the plasma-display-panel-drive apparatus.
Figure 1B:
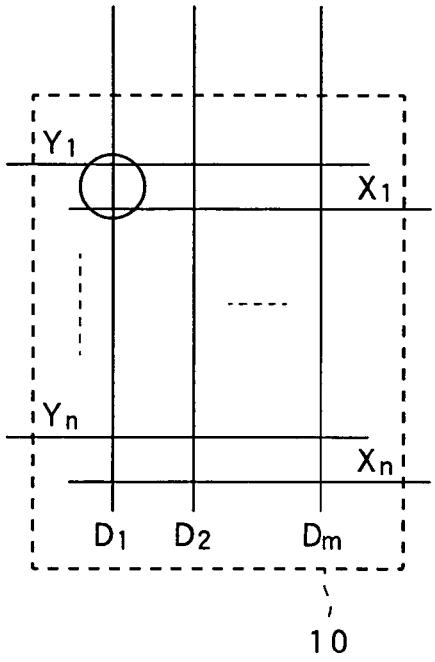
FIG. 1B is a drawing showing the construction of the plasma-display panel.
Figure 2:
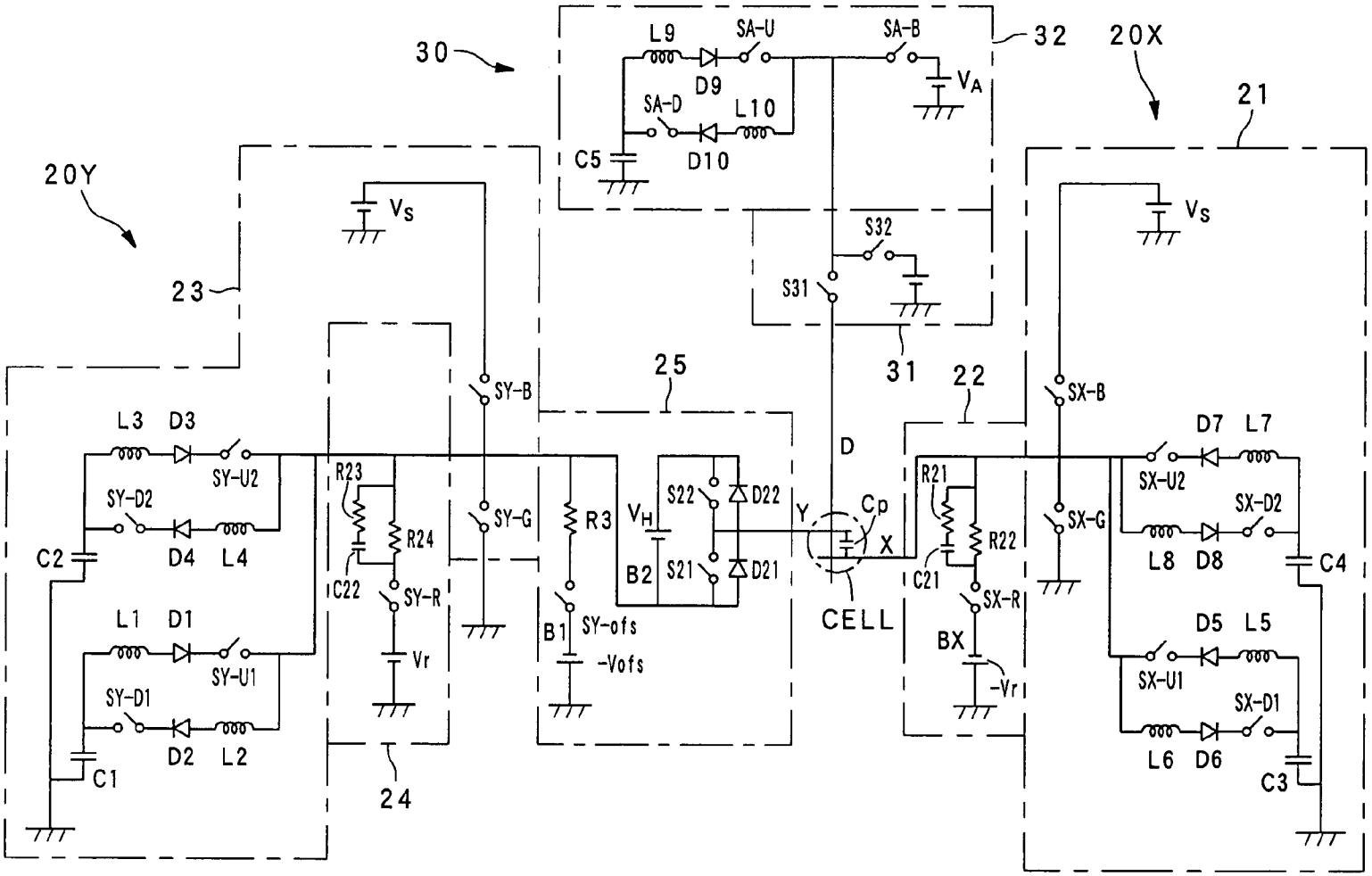
FIG. 2 is a circuit diagram showing the circuitry of the control unit.

FIG. 1A is a block diagram showing the construction of a plasma-display-panel-drive apparatus 100, FIG. 1B is a drawing showing the construction of the plasma-display panel that is driven by the plasma-display-panel-drive apparatus 100, and FIG. 2 is a circuit diagram showing the circuitry of the control unit.

As shown in FIG. 1A, the plasma-display-panel-drive apparatus 100 comprises: a control unit 100A for controlling the generation of drive pulses, and a drive unit 100B that drives the plasma-display panel 10 based on a control signal from the control unit 100A.

As shown in FIG. 1B, the plasma display panel 10 is provided with column electrodes D1 to Dm that run parallel with each other, and row electrodes X1 to Xn and row electrodes Y1 to Yn that run orthogonal to the column electrodes D1 to Dm. The row electrodes X1 to Xn and row electrodes Y1 to Yn are alternately placed, and a pair up of row electrode Xi ($1 \leqq i \leqq n$) and row electrode Yi ($1 \leqq i \leqq n$) make up an ith display line. The column electrodes D1 to Dm and row electrodes X1 to Xn and Y1 to Yn are each formed on two substrates that are attached such that they face each other and seal in discharge gas, and the intersections between column electrodes D1 to Dm and pairs of row electrodes X1 to Xn and row electrodes Y1 to Yn form discharge cells that are the picture elements of the display.

As shown in FIG. 2, the drive unit 10B of the plasma display panel drive apparatus 100 is provided with a row-electrode-drive unit 20X that drives the row electrodes X1 to Xn, a row-electrode-drive unit 20Y that drives the row electrodes Y1 to Yn, and column-electrode-drive unit 30 that drives the column electrodes D1 to Dm. In FIG. 2, the electrodes that form one discharge cell are shown as column electrode D, row electrode X and row electrode Y.

The row-electrode-drive unit 20X is provided with a sustain driver 21 that simultaneously applies an X sustain pulse to the row electrodes X1 to Xn of the plasma display panel 10, and a reset-pulse-generation circuit 22 that generates a reset pulse.

The row-electrode-drive unit 20Y is provided with: a sustain driver that simultaneously applies a Y sustain pulse to the row electrodes Y1 to Yn of the plasma display panel 10, a reset-pulse-generation circuit 24 that generates a reset pulse, and a scan driver 25 that applies a scan pulse in order to the row electrodes Y1 to Yn.

The scan driver 25 comprises: a power supply B1 that generates a voltage -Vof with respect to the ground potential; a resistor R3 that connects the power supply B1 with the output line of the sustain driver 23; a floating power supply B2 that superimposes the voltage VH onto the output line of the sustain driver 23; a switch S21 and switch S22 that are connected to power supply B2 in series; and diode D21 and diode D22 that are connected in parallel with switch S21 and switch S22 respectively.

The column-electrode-drive unit 30 comprises: an address driver 31 that is connected to the column electrodes D1 to Dm, and an address-resonating-power-supply circuit 32 that supplies drive pulses to the address driver 31.

The switches of each of the units of the drive unit 100B are constructed using switching elements that perform switching according to a control signal from the control unit 100A.

Figure 3:
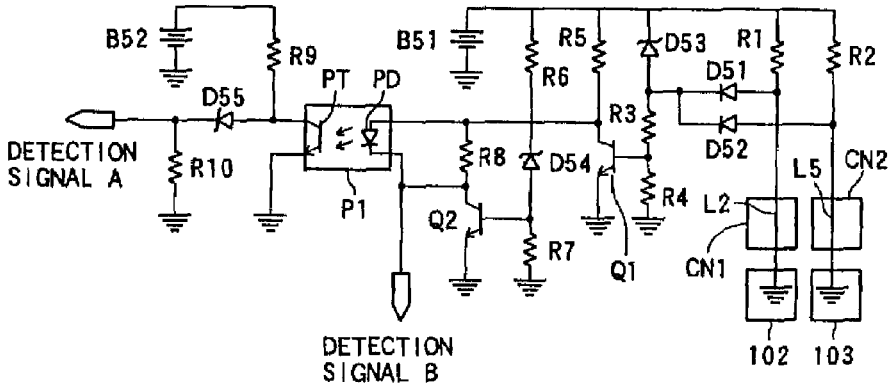
FIG. 3 is a circuit diagram showing a protection circuit for protecting the drive unit 100B.

FIG. 3 is a circuit diagram showing a protection circuit for protecting the drive unit 100B.

As shown in FIG. 3, the protection circuit 50 comprises: transistors Q1 to Q2, diodes D51 to D55, resistors D51 to D55, a photo-coupler P1, and power supply B52. One end of resistor R1 and resistor R2 is connected to the ground line of the drive boards 102, 103 (described later) by way of connection terminals that are located on connector CN1 and connector CN2 (described later). Also, the power supply B5 shown in FIG. 3 is a direct-current power supply (5V) for operating the IC of the control unit 100A, and together with monitoring the fluctuation of the voltage of this direct-current power-supply line, the protection circuit 50 detects when the connector CN1 and connector CN2 are disconnected. The supply line of the power supply B51 is also connected to the drive boards 102, 103 by way of connector CN1 and connector CN2, and the power supply B51 also functions as a power supply for the switching elements of switch S21 and switch S22 of the scan driver 25. The operation of the protection circuit 50 will be described later.

Figure 4:
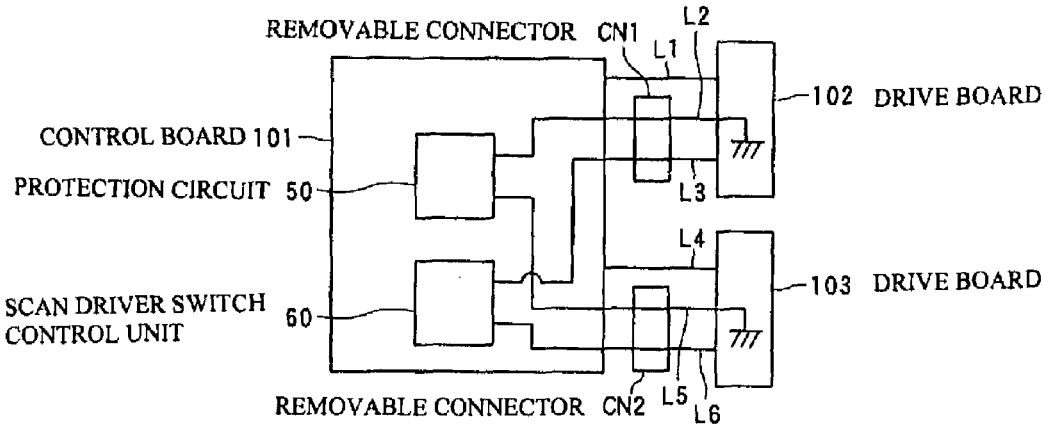
FIG. 4 is a drawing showing a method for mounting the plasma-display-panel-drive apparatus 100.

FIG. 4 is a drawing showing a method of mounting the plasma-display-panel-drive apparatus 100.

As shown in FIG. 4, the plasma-display-panel-drive apparatus 100 comprises: a control board 101 on which mainly the control unit 100A is mounted; and drive board 102 and drive board 103 on which the scan driver 25 (see FIG. 1) of the drive unit 100B is mounted. As shown in FIG. 4, the control board 101 is connected with the drive board 102 by way of transmission lines L1 to L3. Moreover, the control board 101 is connected with the drive board 103 by way of transmission lines L4 to L6. Also, the protection circuit 50 shown in FIG. 3 is mounted on the control board 101.

Furthermore, as shown in FIG. 4, a scan-driver-switch-control unit 60 that generates a control signal for controlling the switches of the scan driver 25 is mounted on the control board 101. The scan-driver-switch-control unit 60 is included in the control unit 100A.

In the transmission line L1 that connects the control board 101 and drive board 102, by using a pressure bond or adhesive bond to place the connection terminals that are formed on the control board 101 and drive board 102 such that they face each other, the conduction state between boards is obtained. Also, in the transmission line L4 that connects the control board 101 and drive board 103, by using a pressure bond or adhesive bond to place the connection terminals that are formed on the control board 101 and drive board 103 such that they face each other, the conduction state between boards is obtained.

On the other hand, the transmission line L2 and transmission line L3 that connect the control board 101 and drive board 102 are constructed such that they have a removable connector CN1. Moreover, the transmission line L4 and transmission line L5 that connect the control board 101 and drive board 103 are constructed such that they have a removable connector CN2. As shown in FIG. 3 and FIG. 4, the transmission line L2 that is connected by way of the connector CN1 is the line that connects the protection circuit 50 with the ground line of the drive board 102. Also, the transmission line L5 that is connected by way of the connector CN2 is the line that connects the protection circuit 50 with the ground line of the drive board 103. When the connector CN1 is in the proper connected state, the protection circuit 50 and the ground line of the drive board 102 are connected together by the transmission line L2 that includes the connection terminal formed on the connector CN1. Also, when the connector CN2 is in the proper connected state, the protection circuit 50 and the ground line of the drive board 103 are connected together by the transmission line L5 that includes the connection terminal formed on the connector CN1.

As shown in FIG. 4, the control signals that are output from the scan-driver-switch-control unit 60 that is mounted on the control board 101 are transmitted to the scan driver 25 that is mounted on the drive board 102 by way of the transmission line L3 that is connected by the connector CN1, are transmitted to the scan driver 25 that is mounted on the drive board 103 by way of the transmission line L6 that is connected by the connector CN2. The control signals that are output from the scan-driver-switch-control unit 60 include control signals for switching switch S21 and switch S22 of the scan driver 25.

In the plasma-display-panel-drive apparatus 100, the control signals that are given to the scan driver 25 in this way, or in other words, the control signals that control turning ON/Off switch S21 and switch S22 (see FIG. 2) are transmitted by way of connector CN1 and connector CN2. Therefore, when connector CN1 or connector CN2 becomes disconnected, these control signals are in a state such that they cannot be sent to the drive board 102 or drive board 103 from the control board 101. Also, as mentioned above, the supply line of the power supply B51 is connected to the drive boards 102, 103 by way of the connectors CN1 and CN2, and the power supply B51 functions as a power supply that operates switch S21 and switch S22 of the scan driver 25. Therefore, when connector CN1 and connector CN2 become disconnected and the power supplied from the power supply B51 is cut off, the switch S21 and switch S22 stop functioning.

Therefore, in this embodiment, when connector CN1 or connector CN2 is disconnected, proper operation is maintained by the protection circuit 50, however this point will be explained later.

Next, the operation of the plasma-display-panel-drive apparatus 100 of this embodiment will be explained.

Figure 5:
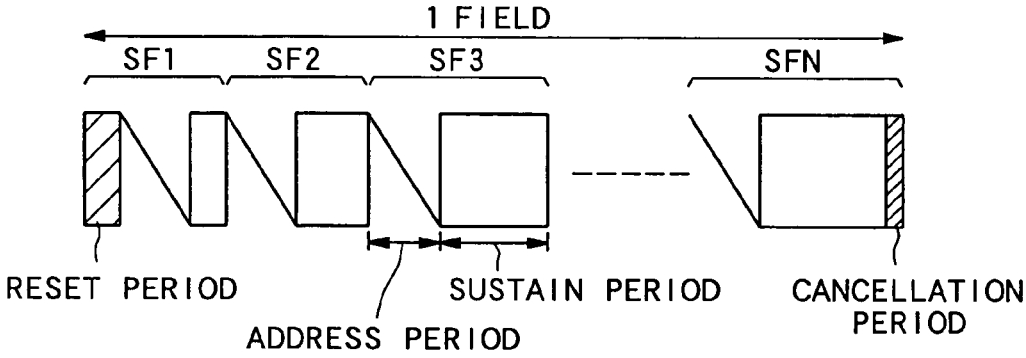
FIG. 5 is a drawing showing the structure of one field.

One field is the period for driving the plasma-display panel 10 and it comprises a plurality of sub-fields SF1 to SFN. As shown in FIG. 5, each sub-field has an address period that selects the discharge cell to be turned ON, and a sustain period during which the cell that was selected during that address period is turned ON for a specified amount of time. Also, there is a reset period located at the start for the first sub-field SF1 for resetting the ON state of the previous field. In this reset period all of the cells are reset as light-emitting cells (cells that carry a wall charge) or non-emitting cells (cells that do no carry a wall charge). In the case of the former, specified cells are switched to light-emitting cells in the following address period. The sustain period gradually becomes longer in the order of sub-fields SF1 to SFN, and by changing the number of sub-fields for which light is continually emitted, a specified graduated display is possible.

Figure 6:
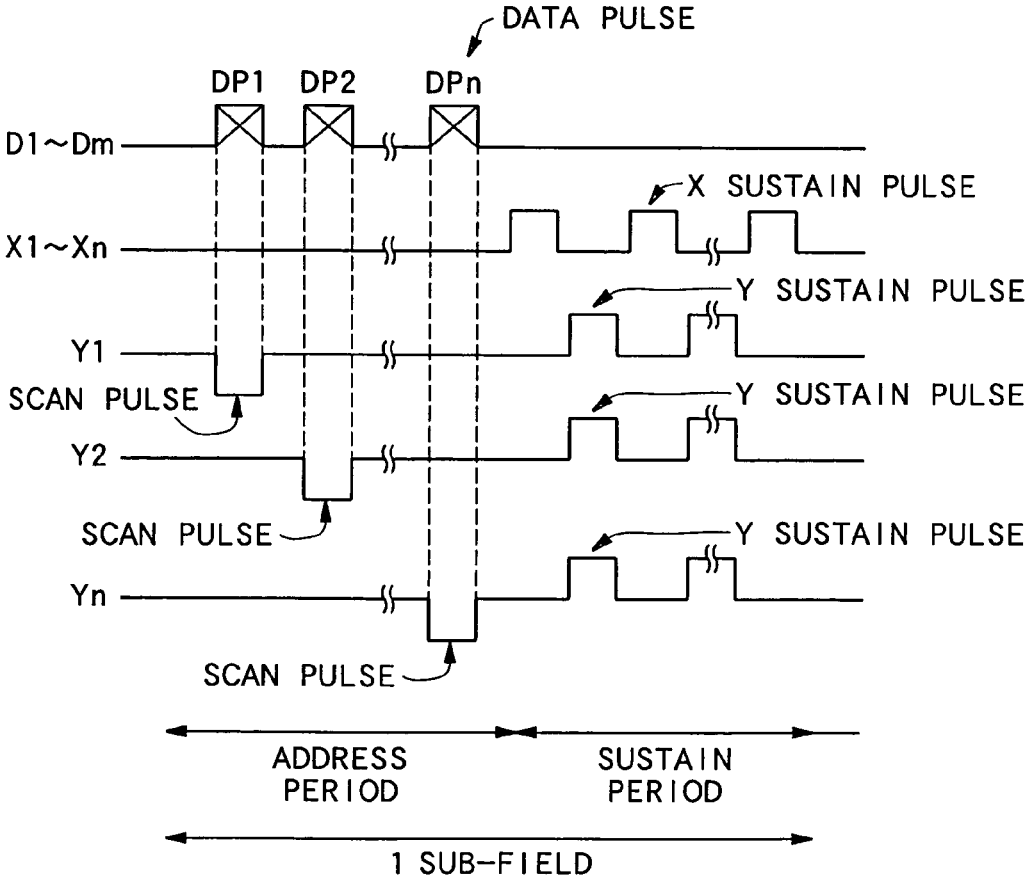
FIG. 6 is a drawing showing a drive pulse in one sub field.

In the address periods of each of sub-fields shown in FIG. 6, address scanning is performed for each line. That is, at the same time that a scanning pulse is applied to the row electrode Y1 of the first line, a data pulse DP1 is applied to the column electrodes D1 to Dm according to the address data corresponding to the cells of the first line; then at the same time that a scanning pulse is applied to the row electrode Y2 of the second line, a data pulse DP2 is applied to the column electrodes D1 to Dm according to the address data corresponding to the cells of the second line. Similarly a scanning pulse and data pulse DP are applied simultaneously for the third line on as well. Finally, at the same time that a scanning pulse is applied to the row electrode Yn of the nth line, a data pulse DPn is applied to the column electrodes D1 to Dm according to the address data corresponding to the cells of the nth line. As described above, in the address period, specified cells are switched from being light-emitting cells to non-emitting cells, or are switched from being non-emitting cells are light-emitting cells.

After address scanning ends in this way, all of the cells in the sub-field are set respectively to being either light-emitting cells or non-emitting cells, and in the following sustain period, each time a sustain pulse is applied, only the light-emitting cells will repeatedly emit light. As shown in FIG. 6, in the sustain period, an X sustain pulse and Y sustain pulse are repeatedly applied at a specified timing to the row electrodes X1 to Xn and row electrodes Y1 to Yn, respectively. Also, in the last sub-field SFN, there is a cancellation period in which all of the cell are set to being non-emitting cells.

Figure 7:
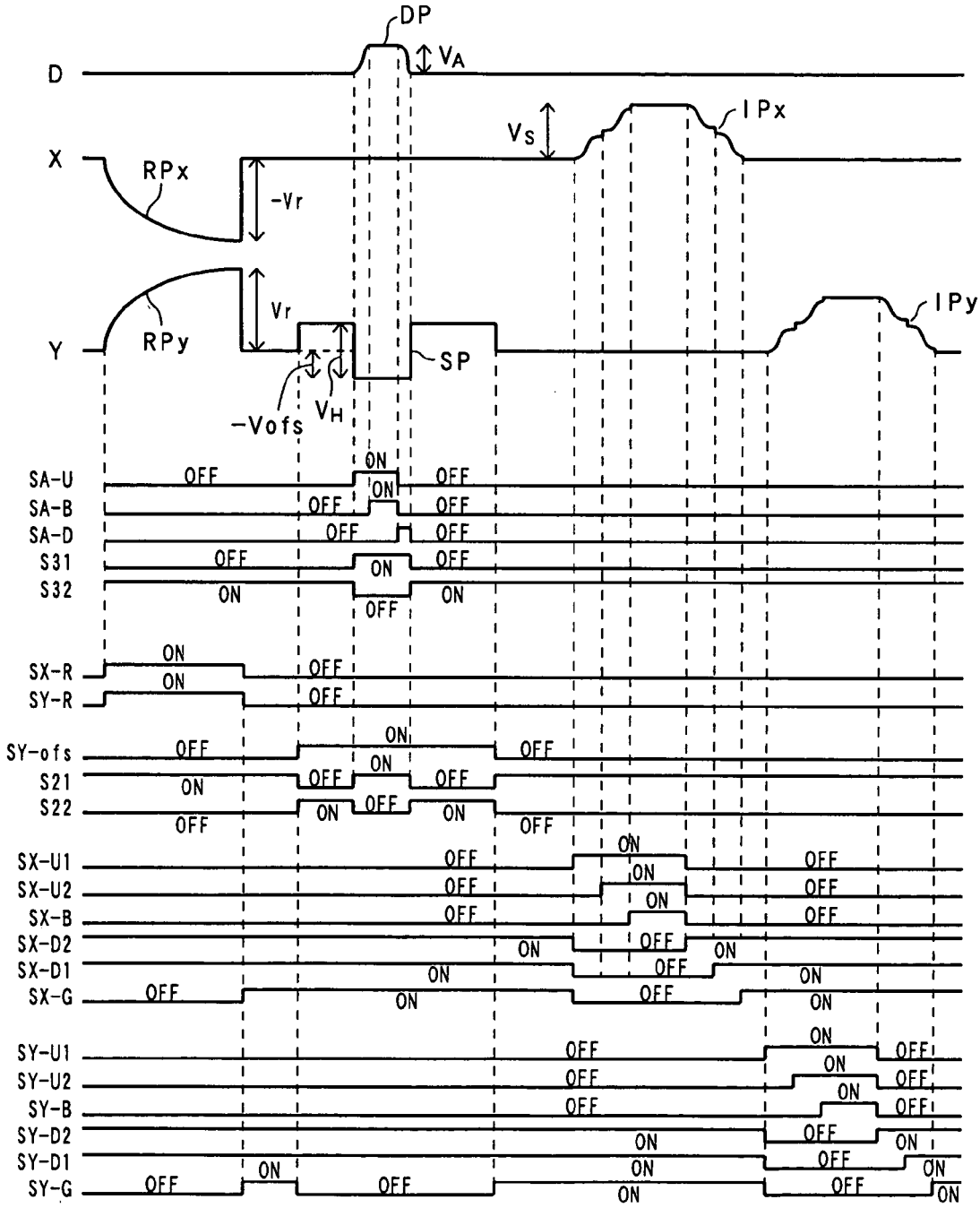
FIG. 7 is a timing chart showing the operation for generating a drive pulse.

Next, the operation when the plasma display panel drive apparatus 100 of this embodiment generates a drive pulse will be explained with reference to FIG. 7. FIG. 7 shows an example of resetting all of the discharge cells to light-emitting cells during the reset period.

In the plasma display panel drive apparatus 100, a drive pulse is generated by switching the switches in each unit of the drive unit 100B shown in FIG. 2 at a specified timing based on a signal from the control unit 100A. The control for switching each of the switches explained below is executed based on a control signal from the control unit 100A.

As shown in FIG. 7, in the reset period, the reset switch SX-R of the reset-pulse-generation circuit 22 and the reset switch SY-R of the reset-pulse-generation circuit 24 are switched ON simultaneously at a specified time.

By doing this, a reset pulse having the shape as shown in FIG. 7 is applied to the row electrodes X1 to Xn and row electrodes Y1 to Yn, and a wall charge is built up at each discharge cell, and all of the discharge cells are reset to light-emitting cells.

As shown in FIG. 7, when reset switch SX-R and reset switch SY-R are switched OFF, switch SX-G of the sustain driver 21 and switch SY-G of the sustain driver 23 are switched ON, and the potentials of the row electrodes X1 to Xn and row electrodes Y1 to Yn are fixed to the ground potential (see FIG. 2).

In reset periods after this, all of the discharge cells are reset to light-emitting cells.

Next, in the address period, the switch SY-ofs of the scan driver 25 is turned ON and the output line of the sustain driver 23 is connected to the potential of -Vofs by way of the resistor R3. Also, the switch 21 of the sustain driver 25 is switched in the order OFF→ON→OFF, and the switch 22 of the sustain driver 25 is synchronously switched in the order ON→OFF→ON (see FIG. 2). By doing this, the potential of the row electrode Yi changes in the order [-Vofs+VH] →[-Vofs]→[-Vofs+VH] (see FIG. 7). In other words, in the address period, this kind of scan pulse SP is applied in order to each of the row electrodes Yi.

At the same time as this, by switching each of the switches of the address driver 31 and address-resonant-power-supply-circuit 32 in order, a data pulse is applied to the column electrodes D1 to Dm at the time that the potential of the row electrode Yi is lowered to [-Vofs].

More specifically, as shown in FIG. 7, by switching the switch S31 of the address driver 31 ON and the switching the switch S32 OFF while the data pulse DP is being output from the address-resonant-power-supply circuit 32, the output from the address-resonant-power-supply circuit 32 is connected to the column electrodes D1 to Dm.

Also, while the output from the address-resonant-power-supply circuit 32 is connected to the column electrodes D1 to Dm, the address-resonant-power-supply circuit 32 generates a data pulse DP. In other words, first the switch SA-U in the address-resonant-power-supply circuit 32 is switched ON. By doing this, current caused by the charge built up in the capacitor C5 flows to the column electrode D by way of the coil L9, diode D9, switch SA-U and switch 31, and gradually increases the voltage of the row electrode D. Next, by switching the switch SA-B ON, the voltage of the column electrode D is fixed to the voltage VA. Then, switch SA-U and switch SA-B are switched OFF, and at the same time switch SA-D is switched ON. By doing this, the current caused by the charge that is built up in the discharge cell flows to the capacitor C5 by way of the switch 31, coil L10, diode D10 and switch SA-D. Therefore, the potential of the column electrode D gradually drops. Finally, at the same time that the switch SA-D is switched OFF, the switch S31 of the address driver 31 is switched OFF, and the switch S32 is switched ON. In this way, the column electrode D is cut off from the address-resonant-power-supply circuit 32, and the potential of the column electrode D is fixed at 0V.

In this way, the discharge cells to which a data pulse DP is given by the scan driver 25 at the timing of the scan pulse SP are selectively set as non-emitting cells.

Next, in the sustain period, and the sustain driver 21 and sustain driver 23 generate an X sustain pulse and Y sustain pulse, respectively.

As shown in FIG. 7, in the sustain driver 25, switch SX-U1 is turned ON, and switch SX-D2 and switch SX-G are both turned OFF. As a result, only switch SX-U1 is ON. Therefore, the current due to the charge stored in the capacitor C3 flows to the capacitance Cp between row electrodes of the discharge cells by way of the coil L5, diode D5, switch SX-U1 and row electrode X, and the potential of the row electrode X increases. Next, when switch SX-U2 is turned ON, the current due to the charge stored in the capacitor C4 flows to the row electrode by way of the coil L7, diode D7 and switch SX-U2, and the potential of the row electrode increases even more. Next, by turning ON switch SX-B, the potential of the row electrode is fixed at Vs. Next switch SX-U1, switch SX-U2 and switch SX-B are turned OFF and switch SX-D2 is turned ON. As a result, only switch SX-D2 is in the ON state. Therefore, the current due to the charge stored in the capacitance between row electrodes flows to the capacitor C4 by way of the row electrode X, coil L8, diode D8 and switch SX-D2, so the potential of the row electrode X decreases. Next, when the switch SX-D1 is turned ON, the current due the charge mentioned above flows to the capacitor C3 by way of the row electrode X, coil L6, diode D6 and switch SX-D1, so the potential of the row electrode decreases even more. Finally, by turning ON the switch SX-G, the potential of the row electrode X is fixed at 0V.

After the potential of the X electrode is fixed at 0V, in the sustain driver 23, switch SY-U1 is turned ON and switch SY-D1, switch SY-D2 and switch SY-G are all turned OFF. As a result, only switch SY-U1 is in the ON state. Therefore, the current due to the charge stored in the capacitor C1 flows to the capacitance Cp between row electrodes by way of the coil L1, diode D1, switch SY-U1 and the row electrode Y, so the potential of the row electrode Y increases. Next, when switch SY-U2 is turned ON, the current due to the charge stored in the capacitor C2 flows to the row electrode Y by way of the coil L3, diode D3 and switch SY-U2, and the potential of the row electrode Y increases even more. Next, by turning ON switch SY-B, the potential of the row electrode is fixed at Vs. Next, switch SY-U1, switch SY-U2 and switch SY-B are turned OFF and switch SY-D2 is turned ON. As a result only switch SY-D2 is in the ON state. Therefore, the current due to the charge stored in the capacitance between row electrodes flows to the capacitor C2 by way of the row electrode Y, coil L4, diode D4 and switch SY-D2, so the potential of the row electrode Y decreases. Next, when switch SY-D1 is turned ON, the current due to the aforementioned charge flows to the capacitor C1 by way of the row electrode Y, coil L2, diode D2 and switch SY-D1, so the potential of the row electrode decreases even more. Finally, by turning ON the switch SY-G, the potential of the row electrode Y is fixed at 0V.

By repeating the operation described above, an X sustain pulse IPx and Y sustain pulse IPy having a waveform as shown in FIG. 7 are alternately generated, and the discharge cells that were selected in the address period, or in other words, just the light-emitting cells emit light a specified number of times.

Next, the operation of the protection circuit 50 (see FIG. 3) will be explained.

Together with operating a microcomputer IC that is located in the control unit 100A that is located on the control board 101, the protection circuit 50 has the function of monitoring the power-supply voltage of the power supply B51 for operating switch S21 and switch S22 of the scan driver 25. Moreover, the protection circuit 50 has the function of detecting when the connector CN1 and connector CN2 are disconnected.

As shown in FIG. 3, the protection circuit 50 outputs two detection signals, detection signal A and detection signal B. Detection signal A is given to the control unit 100A, and when an error is detected, it stops the operation of generating control signals by the control unit 100A. Also, detection signal B is given to the relay circuit that transmits the control signals for controlling the switches of the drive unit 100B, and it controls the transmission of the control signals.

More specifically, in this embodiment, by turning OFF the overall power supply to the plasma-display-panel-drive apparatus 100 by the detection signal A that is output from the protection circuit 50, the generation of control signals is stopped. Included in the power supply that is turned OFF by the detection signal A is the power supply B51 that supplies power to the block that executes generation of the basic control signals such as for the microcomputer of the control unit 100A. Also, the detection signal B that is output from the protection circuit 50 is given to the aforementioned relay circuit and stops transmission of the control signals.

In this embodiment, by turning OFF the overall power supply of the plasma-display-panel-drive apparatus 100 by the detection signal A, the drive unit 100B is finally in a state such that it can be protected. However, in the transition period until the power supply is completely in the OFF state by lowering the power-supply voltage of each unit, there is a possibility that the drive unit 100B will operate according to an abnormal control signal, and thus there is a possibility that the circuit elements could be damaged. Particularly, there is a possibility that damage to the circuit could occur during the transition period due to operating error of the scan driver 25 which handles high voltage. Therefore, in this embodiment, by quickly detecting that the overall power supply of the plasma-display-panel-drive apparatus 100 is OFF, the detection signal B instantaneously stops transmission of control signals, and switch S21 of the scan driver 25 is set to the ON state and switch S22 is set to the OFF state.

The normal operation, and also operation when an error occurs will be explained below.

When connector CN1 and connector CN2 are in the connected state, and when the voltage of the power-supply line of the power supply B51 is in the proper range, or in other words, when the proper operating state is maintained, transistor Q1 is in the OFF state and transistor Q2 is in the ON state. Therefore, due to conduction between the collector and emitter of the transistor Q2, current flows to the photodiode PD of the photo-coupler P1 by way of the resistor R5, and the output transistor PT of the photo-coupler P1. Therefore, the detection signal A that is output from the protection circuit 50 becomes approximately 0V (L). Also, since the transistor Q2 is in the ON state, the detection signal B becomes approximately 0V (L).

Next, in the case where the voltage of the power-supply line of the power supply B51 drops abnormally, the voltage between the terminals of the resister R7 that is connected in series with the resistor R6 and the Zener diode D54 drops, and the base potential of the transistor Q2 drops, and the transistor Q2 goes OFF, so the current flowing to the photodiode PD of the photo-coupler P1 is blocked. Therefore, the output transistor PT of the photo-coupler P1 is OFF, and the voltage of the detection signal A that is output from the protection circuit 50 is increased by the pull-up resistor R9. Therefore, the detection signal A that is output from the protection circuit 50 becomes a positive potential (H). Moreover, since the transistor Q2 is OFF, the detection signal B becomes a positive potential (H).

In this case, after receiving that the detection signal A has transitioned to a positive potential (H), the overall power supply of the plasma-display-panel-drive apparatus 100 is turned OFF. Also, at the same time as this, after receiving that the detection signal B has transitioned to a positive potential (H), transmission of control signals is stopped, and switch S21 of the scan driver 25 is set to the ON state, and switch 22 is set to the OFF state. Therefore, it is possible to protect the drive unit 100B.

In this embodiment, at the instant that a voltage drop in the power-supply line of power supply B51 is detected, the detected value is set such that normal control signals are output from the control unit 100A. Therefore, before an abnormal control signal is given to the scan driver 25, transmission of the control signals is stopped and the switches of the scan driver 25 are forcibly set to a specified state, so it is possible to protect the drive unit 100B.

The operation described above also corresponds to the state when the power supply of the plasma-display-panel-drive apparatus 100 is turned OFF manually, and thus it is possible to prevent damage to the drive unit 100B immediately after the power supply is turned OFF.

On the other hand, in the case where the voltage of the power-supply line of power supply B51 rises abnormally, the voltage between the terminals of the resistor R4 that is connected in series with the Zener diode D53 rises, and thus the base potential of the transistor Q1 rises and the transistor Q1 is turned ON. Therefore, the anode of the photodiode PD is fixed at the ground potential, and current flowing to the photo diode PD of the photo-coupler P1 is blocked. As a result, the output transistor PT of the photo-coupler P1 is in the OFF state, and the voltage of the detection signal A that is output from the protection circuit 50 is raised by the pull-up resistor R9. Therefore, the detection signal A that is output from the protection circuit 50 becomes a positive potential. However, at this instant, the transistor Q2 is turned ON and the potential of the detection signal B becomes approximately 0V (L).

In this case, after receiving that the detection signal A has transitioned to a positive potential (H), the overall power supply of the plasma-display-panel-drive apparatus 100 is turned OFF.

Next, the voltage of the power-supply line of the power supply B51 is normal, however, when the connector CN1 is disconnected, the resistor R1 is disconnected from the ground line of the drive board 102. By doing this, current flows to resistor R3 and resistor R4 by way of the pull-up resistor R1 and diode D51, and the voltage between the terminals of the resistor R4 rises and thus the base potential of the transistor Q1 rises, so the transistor Q1 is turned ON. Therefore, the anode of the photodiode PD is fixed at the ground potential, and current flowing to the photodiode PD is blocked. As a result, the output transistor PT of the photo-coupler P1 is in the OFF state, and the voltage of the detection signal output from the protection circuit 50 is raised by the pull-up resistor R9. Therefore, the potential of the detection signal A that is output from the protection circuit 50 becomes a positive potential (H). However, at this instant, the transistor Q2 is turned ON and the potential of the detection signal B is approximately 0V (L).

In this case, after receiving that the detection signal A has transitioned to a positive potential (H), the overall power supply of the plasma-display-panel-drive apparatus 100 is turned OFF.

Next, the voltage of the power-supply line of the power supply B51 is normal, however, when the connector CN2 is disconnected, the resistor R2 becomes disconnected from the ground line of the drive board 103. From this, current flows to resistor R3 and resistor R4 by way of the pull-up resistor R2 and diode D52, and the voltage between both terminals of the resistor R4 rises and thus the base potential of the transistor Q1 rises, so the transistor Q1 is turned ON. Therefore, the anode of the photodiode PD is fixed at ground potential, and current flowing to the photodiode of the photo-coupler P1 is blocked. As a result, the output transistor PT of the photo-coupler P1 is set to the OFF state, and the voltage of the detection signal that is output from the protection circuit 50 is raised by the pull-up resistor R9. Therefore, the detection signal A that is output from the protection circuit 50 becomes positive potential. However, at this instant, the transistor Q2 is turned ON and the potential of the detection signal B is approximately 0V (L).

In this case, after receiving that the detection signal A has transitioned to positive potential (H), the overall power supply of the plasma-display-panel-drive apparatus 100 is turned OFF.

In this embodiment, when the detection signal A that is output from the protection circuit 50 becomes positive potential (H), or in other words, when it is detected that connector CN1 and connector CN2 are disconnected, the overall power supply of the plasma-display-panel-drive apparatus 100A is turned OFF. Also, by the detection signal B transitioning to positive potential (H), transmission of control signals is stopped, and switch S21 and switch S22 of the scan driver 25 are forcibly set to specified states. Therefore, it is possible to prevent damage to the drive unit 100B.

As was explained above, the display-panel-drive apparatus 100 of this embodiment comprises: drive boards 102, 103 of the drive unit 100B; control board 101 of the control unit 100A; transmission lines L3, L6 that transmit control signals from the control board 101 to the drive boards 102, 103 by way of removable connectors CN1, CN2; and a protection circuit 50 that detects when the connectors CN1, CN2 are disconnected, and controls the drive unit 100B when it is detected that the connectors CN1, CN2 are disconnected; and where the protection circuit 50 detects when the connectors CN1, CN2 are disconnected by detecting when the connection terminals contained in the connectors CN1, CN2 are disconnected.

Therefore, when it becomes impossible to properly transmit control signals by way of the transmission lines L3, L6 because the connectors CN1, CN2 are disconnected, it is possible for the protection circuit 50 to adequately control the drive unit 100B. Therefore, it is possible to prevent abnormal displays due to abnormal control signals, and to prevent damage to the drive unit 100B.

In this embodiment, an example was explained in which the overall power supply of the plasma-display-panel-drive apparatus 100 was turned OFF and the operation of the scan driver 25 was stopped when the an error was detected, however, operation when an error is detected is not limited to this. Also, the display-panel-drive apparatus of this invention can be widely applied to apparatuses for driving display panels other than a plasma display panel.

In regards to the embodiment described above and the claims of the disclosure, the drive unit 100B and scan driver 25 correspond to the 'drive unit', the scan-driver-switch-control unit 60 and control unit 100A correspond to the 'control unit', the drive boards 102, 103 correspond to the 'drive board', the control board 101 corresponds to the 'control board', the protection circuit 50 corresponds to the 'detection circuit' and 'control circuit', the connectors CN1, CN2 correspond to the 'connector' and the transmission lines L3, L6 correspond to the 'transmission line'.

It should be understood that various alternatives to the embodiment of the invention described herein may be employed in practicing the invention. Thus, it is intended that the following claims define the scope of the invention and that methods and structures within the scope of these claims and their equivalents be covered thereby.

The entire disclosure of Japanese Patent Application No. 2003-108625 filed on Apr. 14, 2003 including the specification, claims, drawings and summary are incorporated herein by reference in its entirety.

What is claimed is:

1. A display-panel-drive apparatus having a drive unit that drives the display panel and a control unit that outputs control signals for controlling said drive unit, the display-panel-drive apparatus comprising:

a drive board of said drive unit;

a control board of said control unit;

a transmission line that transmits said control signals from said control board to said drive board by way of a removable connector;

a detection device that detects when said connector is disconnected; and a control device that controls said drive unit when said detection device detects that said connector is disconnected; and wherein said detection device detects that said connector is disconnected by detecting when connection terminals which are included in said connector are disconnected;

wherein said control device stops operation of said drive unit when said detection device detects that said connector is disconnected, wherein said control signals are signals that cause said drive unit to output scan pulses given to successive display lines for setting some of the discharge cells located on said display panel as light-emitting cells and some of non-emitting cells, wherein said drive unit includes first switch (S21) and second switch (S22) which are connected to a power supply (B2), and scan pulses are outputted from a connection point between the first switch (S21) and the second switch (S22), wherein when said detection device detects that said connector is disconnected, the first switch (S21) is set to ON state and the second switch (S22) is set to OFF state.

2. A display-panel-drive comprising:

a drive process of driving the display panel;

a control process of outputting control signals for controlling said drive process;

a transmission process of transmitting said control signals from a control board to a drive board by way of the removable connector; and a detection process of detecting when said connector is disconnected, wherein said control process stops said drive process when said detection process detects that said connector is disconnected;

said detection process detects that said connector is disconnected by detecting when the connection terminals which are included in said connector are disconnected; and said control signals are signals that cause said drive process to output scan pulses given to successive display lines for setting some of the discharge cells located on said display panel as light-emitting cells and some as non-emitting cells' wherein a part of said drive process executed by a first switch (S21) and a second switch (S22) which are connected to a power supply (B2), and scan pulses are outputted from a connection point between the first switch (S21) and the second switch (S22), wherein when said detection process detects that said connector is disconnected, the first switch (S21) is set to ON state and the second switch (S22) is set to OFF state.

* * * * *